US005219303A

United States Patent [19]

Daly et al.

[11] Patent Number: 5,219,303

[45] Date of Patent: Jun. 15, 1993

[54] MID-CABLE ELECTRICAL TERMINATION

[75] Inventors: John K. Daly, Scottsdale, Ariz.; Kenneth F. Folk, Harrisburg; John G. Hatfield, Camp Hill, both of Pa.; Dean A. Puerner, Maricopa, Ariz.

[73] Assignee: AMP Incorporated, Harrisburg, Pa.

[21] Appl. No.: 835,154

[22] Filed: Feb. 13, 1992

[51] Int. Cl.[5] ..... H01R 4/24

[52] U.S. Cl. ..... 439/422

[58] Field of Search ..... 439/421, 422, 492–499

[56] References Cited

U.S. PATENT DOCUMENTS

| | | | |
|---|---|---|---|
| 3,247,316 | 4/1966 | Weimer, Jr. | 439/422 |
| 4,241,498 | 12/1980 | Brandeau | 29/861 |
| 4,560,224 | 12/1985 | Weisenburger | 439/422 |
| 4,859,204 | 8/1989 | Daly et al. | 439/424 |
| 4,867,700 | 9/1989 | Kreinberg | 439/422 |
| 4,900,264 | 2/1990 | Bennett et al. | 439/391 |
| 4,915,650 | 4/1990 | Daly et al. | 439/498 |
| 4,921,442 | 5/1990 | Puerner | 439/499 |
| 4,975,080 | 12/1990 | Daly et al. | 439/422 |
| 4,975,081 | 12/1990 | Daly et al. | 439/498 |

*Primary Examiner*—Joseph H. McGlynn
*Attorney, Agent, or Firm*—Anton P. Ness

[57] ABSTRACT

An initially integral terminal useful for terminating to flat conductor cable includes upper and lower plate sections coextending from a hinge to define a cable-receiving region therebetween, with first and second portions of both plate sections defining opposed cooperative arrays of termination means for terminating to said flat cable upon said upper and lower plate sections being pressed toward each other and into the flat cable. Upstanding opposed side wall sections join the first and second portions which are otherwise separated by an aperture proximate the center of the flat cable, enabling easy severing of the side walls at the aperture to define separate electrical terminations after application of the assembly to the flat cable. One or two contact sections can extend from a free edge of one of the upper and lower plate sections for connection to another article, defining a mid-cable tap for either single- or dual-connector cable respectively.

20 Claims, 13 Drawing Sheets

MID-CABLE ELECTRICAL TERMINATION

FIELD OF THE INVENTION

The present invention relates to the field of electrical connectors and more particularly to terminals for use with flat power cables.

BACKGROUND OF THE INVENTION

U.S. Pat. Nos. 4,867,700 and 4,859,204 disclose terminals which are crimped onto a flat power cable by penetrating the insulation covering the cable's flat conductor and also shearing through the conductor at a plurality of locations. The cable is of the type entering commercial use for transmitting electrical power of for example 75 amperes nominal, and includes a flat conductor one inch wide and about 0.020 inches thick with an extruded insulated coating of about 0.004 to 0.008 inches thick over each surface with the cable having a total thickness averaging about 0.034 inches. One embodiment of terminal is stamped and formed of sheet metal and includes a pair of opposing plate sections disposed along respective major surfaces of the cable and including opposing termination regions extending transversely across the cable. Each terminating region includes a transverse array of alternating shearing wave shapes and relief recesses of equal width, the relief recesses defined by arcuate projections extending away from the cable-proximate side, and the wave shapes extending outwardly from the cable-proximate side and toward relief recesses in the opposed plate section. Each shearing wave shape has a transverse crest between parallel side edges, and the side edges of the corresponding relief recesses are associated with the wave side edges to comprise pairs of shearing edges, preferably with zero clearance. When the plate sections are pressed against a cable section disposed therebetween the crests of the wave shapes initiate cable shearing by their axially oriented side edges cutting through the cable insulation and into and through the metal conductor. The wave shapes extrude the sheared cable strips outwardly into the opposing relief recesses as the shears propagate axially along the cable for limited distances, forming a series of interlocking wave joints with the cable while exposing newly sheared edges of the cable conductor for electrical connection therewith.

Further with regard to the terminal of the above patents, fastened to the outwardly facing surface of the plate sections at the terminating regions are respective inserts of low resistance copper. The inserts have terminal-facing surfaces conforming closely to the shaped outer surface of the terminating region, with alternating wave shapes and apertures disposed outwardly of and along the terminal wave shapes and relief recesses. Upon termination the wave joints are within the insert apertures, and the sheared edges of the adjacent conductor strips and of the terminal wave shapes which formed the sheared strips are adjacent to side surfaces of the copper insert apertures. A two-step staking process is preferred: in a first step the wave joints are split axially so that portions of each arcuate shape of both terminal plate sections are forced inwardly against the adjacent sheared conductor strip of the respective wave joint to define spring fingers whose ends pin the conductor strip against the opposing wave crest to store energy in the joint; and in the second step a staking process deforms the insert between the sheared strips to deform the copper against the sheared conductor and wave shape edges, forming gas-tight, heat and vibration resistant electrical connections with the cable conductor and with the terminal, so that the inserts are electrically in series at a plurality of locations between the conductor and the terminal.

A contact section is integrally included on the terminal enabling mating with corresponding contact means of an electrical connector, or a bus bar, or a power supply terminal, for example, and can include a plurality of contact sections to distribute the power to a corresponding plurality of contact means if desired. A housing or other dielectric covering can be placed around the termination as desired, such as is disclosed in U.S. Pat. Nos. 4,900,264 and 4,921,442.

Also entering commercial acceptance is a dual-conductor flat cable, wherein a pair of parallel spaced coplanar flat conductor strips having insulation extruded therearound define power and return paths for electrical power transmission. One method has been devised for terminating an end of such dual-conductor cable, as is disclosed in U.S. Pat. No. 4,915,650, where the cable end is first slotted between the respective conductors, to define tabs insertable into slots at the rearward end of the initially integral terminal, after which the plate sections of the terminal are thereagainst, defining the wave joint termination, after which the terminal is bisected into discrete terminals associated with the respective conductors and electrically isolated from each other. U.S. Pat. No. 4,900,264 discloses a connector, terminals and method for interconnecting a pair of flat power cables together, such as to terminate an end of a tap cable along a continuous length of main cable. For dual-conductor cable a pair of terminal assemblies are used, each interconnecting one conductor of each cable to the associated conductor of the other cable aligned therewith and superposed thereover, by opposing terminal portions each containing a terminating region of shearing wave shapes on one half thereof opposing a like region of the other being crimped against the cables and thereafter staked, with the opposing terminal portions of each terminal assembly being riveted together at flange portions laterally beside the cables on each side.

In U.S. Pat. No. 4,975,081 a pair of upper and lower terminal portions is crimped against superposed dual-conductor cables on each side of the cable at a selected location along a continuous portion of at least one of the cables, for interconnecting a conductor of one with the associated conductor of the other; after interconnection of both such conductor pairs with respective terminal assemblies, a common housing is secured thereover. In one embodiment, the upper portions of both terminal assemblies are initially integral as are the lower portions of both, joined by respective ligature pairs at the median of the cable between the conductors; after termination the ligatures are removed by tooling to define discrete terminations, with a wall of the dielectric housing providing necessary insulation therebetween by extending between the terminal assemblies and through a slot through the cable median also formed by the tooling.

It is desired to provide a terminal for interconnecting a pair of flat power cables at a location along a continuous length of at least one of the cables, where the cables each include two flat conductors defining separate power circuits, and where the interconnections remain gas-tight and heat and vibration resistant over time.

It is also desired to provide an initially integral terminal assembly which can interconnect both conductors of each of two dual-conductor flat power cables, to facilitate handling and application.

It is further desired to provide a terminal assembly for connecting a flat power cable at a location along a continuous length thereof and define a contact section extending from the termination for mating with a complementary contact section for another electrical article such as a terminal post of a power supply or to terminals of wires or other conductor means.

It is additionally desired to provide an initially integral terminal assembly which can be terminated at a middle portion of a dual-conductor flat power cable and provide discrete contact sections for mating with respective complementary contact sections of separate circuits, to facilitate terminal handling and application.

SUMMARY OF THE INVENTION

The present invention is a terminal assembly applicable to at least one flat power cable, dual or single-conductor, midway along its continuous length; various embodiments of the same fundamental structure adapt it for interconnecting two flat cables, or for providing a contact section for mounting to a terminal post of a battery, for example, or for providing a pair of contact sections for mating with contact sections of terminals of discrete power cables. A single assembly is applied to the cable or cables which is then severable into two discrete terminals corresponding to the two conductors of dual-conductor cable to define discrete circuits. The single assembly comprises an upper terminal portion and a lower terminal portion joined to each other at an integral hinge joint; when applied to the cable, the upper and lower terminal portions extend at a substantial acute angle to permit placement of the cable or cables therebetween with one lateral cable edge disposed adjacent the hinge joint; afterward the terminal portions are carefully rotated within applicator tooling to be parallel with the cable or cables and thereafter pressed against and into the cable or cables. The termination regions of both upper and lower terminal portions define complementary wave arrays which shear the cable conductors into strips and express the strips from the plane of the cable or cables to expose edges of the conductor strips, and the terminal establishes assured electrical connections with the exposed conductor edges which are made gas-tight by staking the terminal portions.

Where termination is being made to dual-conductor cable in contradistinction to single-conductor cable, other tooling then can sever the ligatures which initially joined to the two halves of the upper terminal portion to each other and the two halves of the lower terminal portion to each other, each half adjacent a respective half of the cable or cable and associated with a respective conductor or conductors of that half. With a slot previously punched into the cable or cables between the two conductors in a dual-conductor cable, or through the sole conductor of a single-conductor cable, a wall section of a housing cover extends through the slot and between the now-severed two halves of the respective upper and lower portions of the terminal assembly to assure dielectric material between the terminations; such a wall section in a single-conductor cable is merely innocuous, and the same terminal assembly and application method and application tooling can be used irrespective of whether or not the cable is single-conductor or dual-conductor cable.

In one embodiment of the present invention a contact section extends from the hinge-remote end of either the upper or lower terminal portion, adapted to be mounted on a terminal post for mid-cable termination. When used with single-conductor cable, the ligatures joining both upper terminal portions to each other and both lower terminal portions to each other, need not be severed; with such embodiment, the same terminal assembly can be applied to two such single-conductor cables, thereby commoning the cables and doubling the current passing through the single contact section by adding the currents of both cables. If used with dual-conductor cable, the ligatures are severed as previously described, and the contact section connects only one particular conductor of the dual-conductor cable to a terminal post, for example.

In another embodiment a pair of contact sections extend from side edges of either the upper or lower terminal portions aligned axially along the cable and preferable offset therefrom, for mating with complementary contact sections of terminals terminated on discrete cables; such contact sections connect each of the respective conductors of dual-conductor cable to corresponding discrete cables, and preferably are disposed within terminal-receiving apertures of a housing surrounding the termination which insulates the electrical connections from inadvertent contact for safety For interconnecting one flat cable to another, no contact sections are provided on the terminal assembly, and the entire termination is enclosed within a housing A housing for the present invention can preferably comprise upper and lower covers latchable together, and the same housing covers can be utilized for both the two-cable interconnection and for the terminal post connection, where the single contact section can extend outwardly through an incremental space between the facing side edges of the housing covers which otherwise exposes only insulated side edges of the cable therewithin; the contact section can be provided with an aperture through which can extend the latch arm of one of the covers to latch to a corresponding projection of the other cover.

It is an objective of the present invention to provide an initially integral terminal assembly for ease of application to one or two flat power cables midway along a continuous length of the cable.

It is another objective to provide a single fundamental terminal structure usable with corresponding tooling for a cable-to-cable interconnecting termination as for a connection to a single cable by a terminal post or other conductor means, without modification of the assembly procedure or the tooling.

It is yet another objective to provide such a terminal structure usable with either single-conductor cable or dual-conductor cable without modification of the assembly procedure or the tooling.

It is also a further objective to provide a terminal assembly for connecting conductors of a pair of flat power cables simultaneously at a common location along continuous lengths thereof and define a single contact section extending from the termination for mating with a complementary contact section of another electrical article, thereby providing a single terminal terminated to a pair of cables and thereby providing a means for doubling the current carrying capability in the connection to the other electrical article.

Embodiments of the present invention will now be described by way of example with reference to the accompanying drawings.

DETAILED DESCRIPTION OF THE PREFERRED EMBODIMENTS

Figure 1:
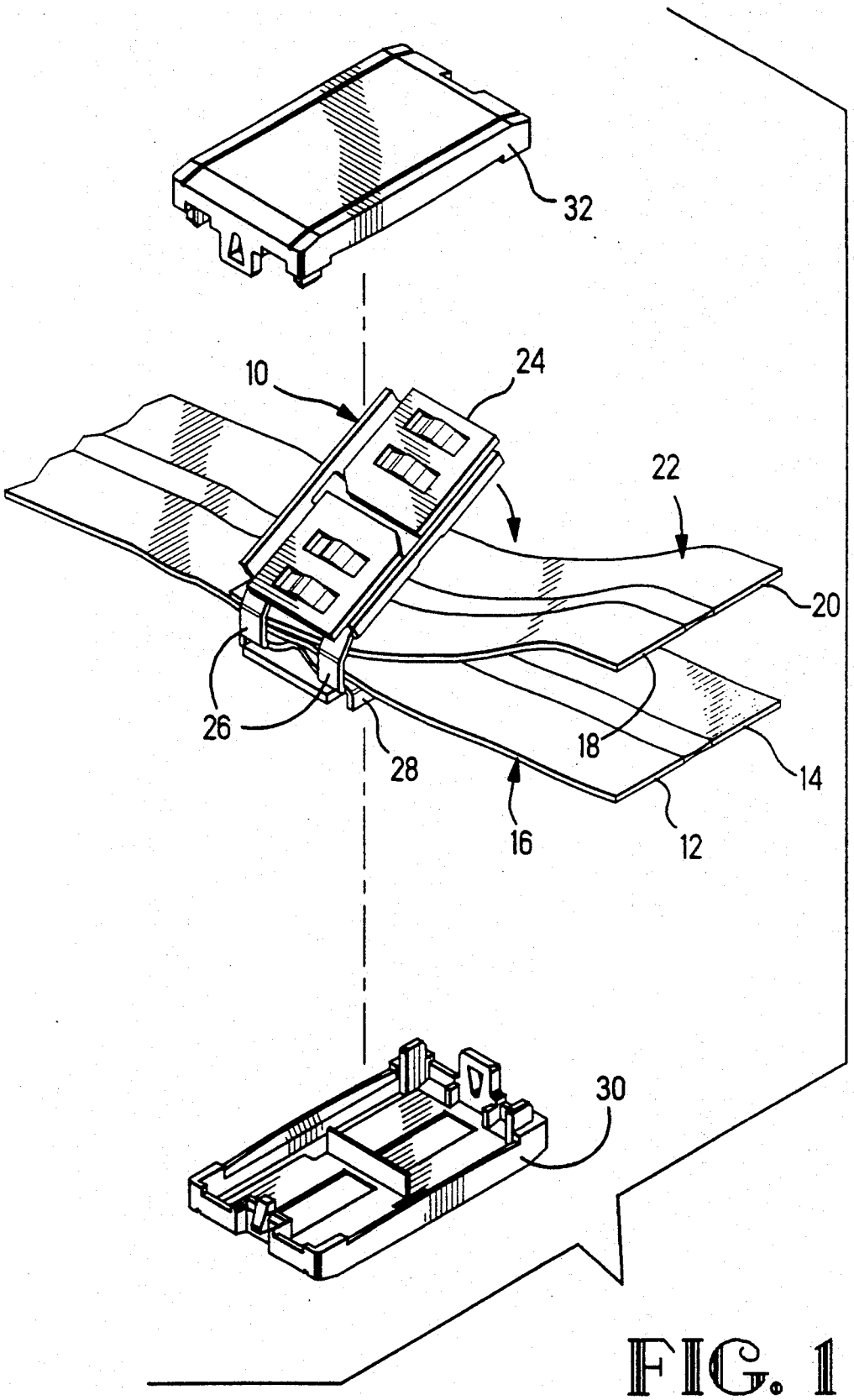
FIG. 1 is an isometric view of a representative terminal assembly of one embodiment of the present invention about to be applied to a pair of flat dual-conductor cables midway along a continuous length of one of them, and representative housing covers to be applied therearound upon completion of the termination.
Figure 2:
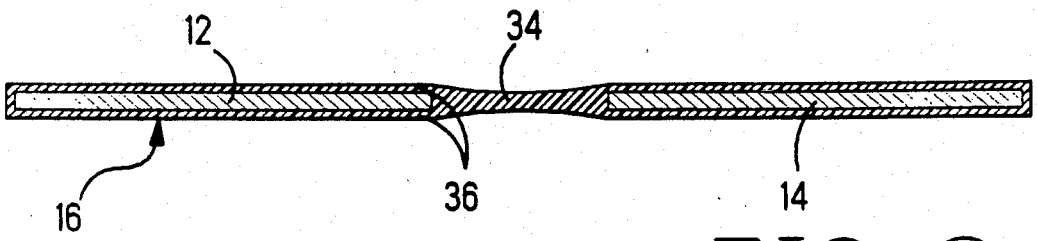
FIG. 2 is a cross-section of a typical flat power cable having two flat conductors.
Figure 3:
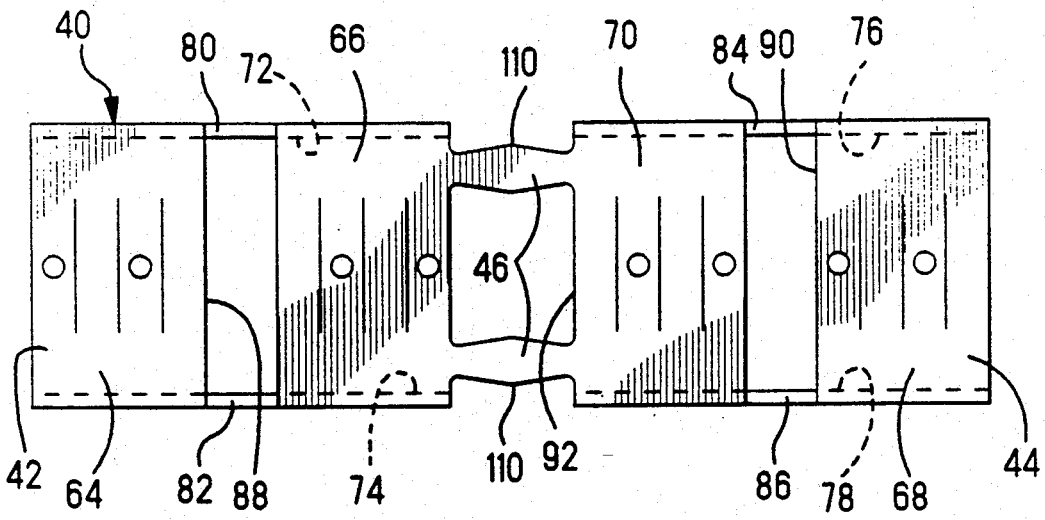
FIG. 3 is a plan view of a blank of the cable-proximate member of the terminal assembly of FIG. 1 prior to bending at the integral hinge joint.

FIG. 1 is representative of a first embodiment of the present invention, an initially integral terminal assembly 10 for interconnecting each conductor 12,14 of a continuous length of main power cable 16 with a corresponding conductor 18,20 of an end of tap cable 22 overlying and aligned with main cable 16. Terminal assembly 10 includes an upper terminal portion 24 joined at a hinge 26 to a lower terminal portion 28 and about to be rotated and pressed together to establish electrical connections between the paired conductors 12,18;14,20. A pair of housing covers 30,32 will be applied around the completed termination by being latched to each other along sides of the cable, with covers 30,32 shown to be identical and hermaphroditic. An example of such a flat power cable 16 (and 22) is illustrated in cross-section in FIG. 2, wherein conductors 12,14 are flat and spaced apart at median 34, with a jacket of dielectric material 36 extruded therearound.

In FIGS. 3 through 6 terminal assembly 10 is seen to have an initially integral cable-proximate member 40 having first and second portions 42,44 joined at a pair of hinge sections 46. A pair of insert members 48,50 are secured to cable-remote surface 52 of first terminal portion 42 to define an upper terminal portion 54, and a pair of insert members 56,58 are likewise secured to cable-remote surface 60 of second terminal portion 44 to define a lower terminal portion 62. First and second portions 42,44 of cable-proximate member 40 include first and second halves 64,66;68,70 joined by pairs of upturned side edges 72,74;76,78 at pairs of opposed ligatures 80,82;84,86. Pairs of opposed ligatures 80,82;84,86 surround openings 88,90 corresponding to median 34 of a cable 16, and pair of hinge sections 46 form an opening 92 which will be disposed along a side edge of cable 16, when terminal assembly 10 is applied to the cable.

Figure 4:
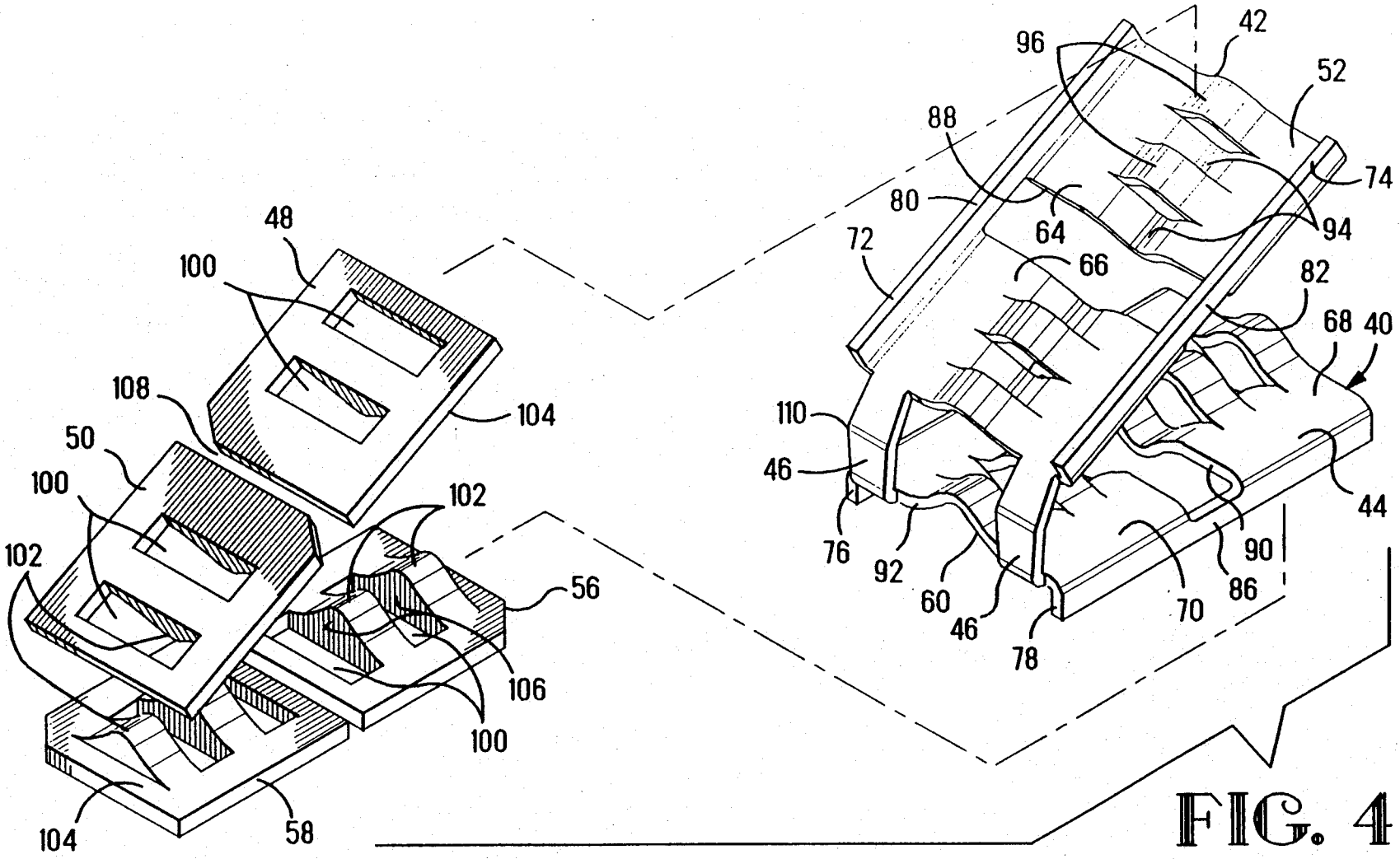
FIG. 4 is an isometric view of the plurality of discrete insert members being applied to cable-remote sides of the cable-proximate member of FIG. 3.
Figure 5:
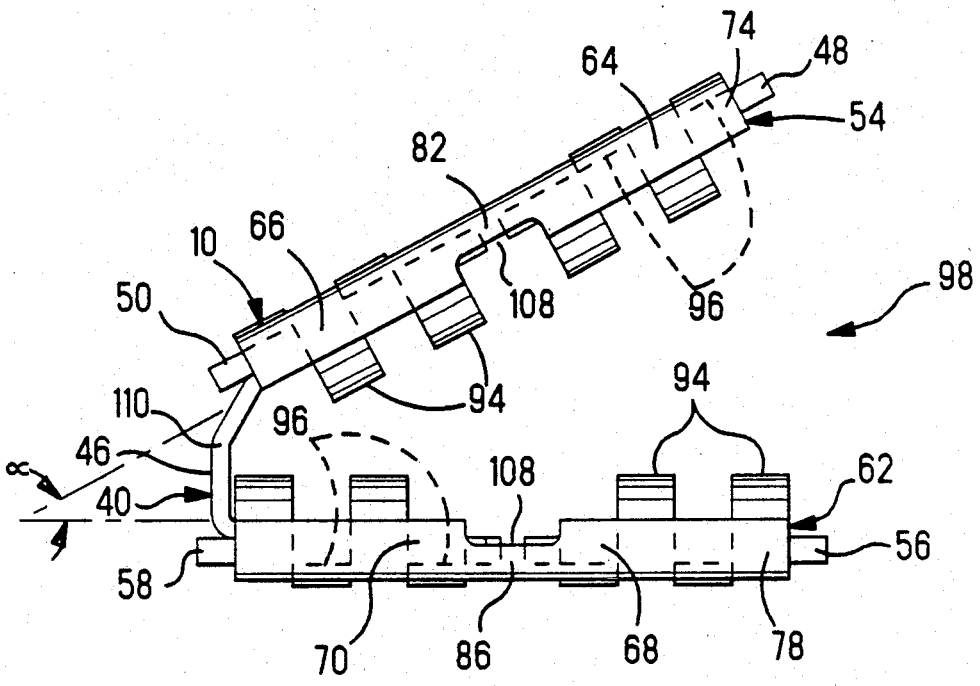
FIGS. 5 and 6 are side and end views of the complete terminal assembly of the present invention.
Figure 6:
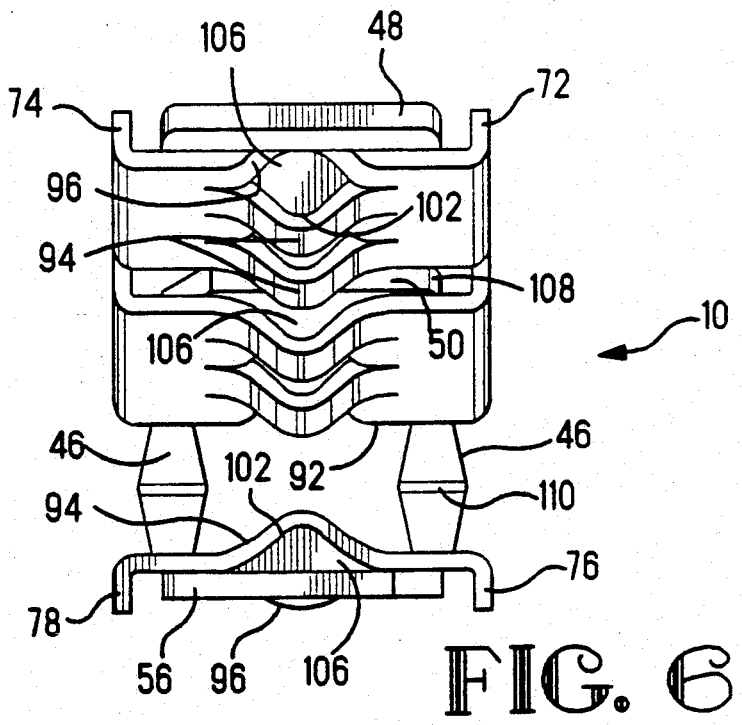

First and second halves 64,66;68,70 of upper and lower terminal portions 54,62 include termination regions comprising arrays of wave shapes 94 alternating with arcuate relief shapes 96 surrounding a cable-receiving region 98, best seen in FIGS. 4 and 6, and the wave shapes 94 of each of the upper and lower terminal portions 54,62 oppose the relief shapes 96 of the other terminal portion to be received into the relief recesses they define during termination to the cable. Such wave shape termination is disclosed in U.S. Pat. Nos. 4,867,700 and 4,859,204 to shear conductor strips to expose conductor edges for gas-tight electrical connection interfaces with the terminal assembly; such paired shearing wave shape arrays of halves of upper and lower terminal assemblies for dual-conductor cable is also disclosed in U.S. Pat. No. 4,975,081.

In insert members 48,50,56,58 are wave-receiving apertures 100 alternating with insert wave shapes 102 formed across cable-proximate surfaces 104 to conform with the cable-remote surface of cable-proximate member 40 to which the insert members are affixed such as preferably by light staking as disclosed in U.S. Pat. No. 4,867,700, with arcuate relief shapes 96 disposed within apertures 100 between facing side surfaces 106 thereof. Upon assembly to cable-proximate member 40, inserts 48,50 of upper terminal portion 54 are spaced from each other by a gap 108 as are insert members 56,58 of lower terminal portion 62.

Terminal assembly 10 is formed at hinge joints 46 preferably to a preselected angle such as between 20° and 35° and preferably about 28° to define a cable-receiving region 98 open wide enough to permit insertion of cables 16,22 thereinto edgewise toward hinge joints 46. It is preferred that one bend 110 is provided at widened portions of hinge joints 46 to provide for initiation of the eventual bend of almost 180° thereat during application to the cables by tooling. Optionally the assembly could be formed with the upper and lower portions parallel and spaced apart with their wave arrays precisely opposed, for movement together for termination to one or two cables placed therebetween.

Application of terminal assembly 10 to cables 16,22 is performed preferably with tooling including a ram to generate compression of the upper and lower terminal portions against the cables therebetween up to for example about 3700 pounds for termination to a single cable 0.010 inches thick to 6000 pounds for a pair of cables each 0.020 inches thick with heavy insulation. In FIGS. 7 to 10 a terminal assembly 10 is placed in the nest of lower tooling 150 between precisely located surfaces 152 which includes a pair of upstanding pins 154 extending vertically between first and second halves 68,70 of lower terminal portion 62, in opening 92 of cable-proximate member 40 and in gap 108 between insert members 56,58. Cable 16 first is punched along median 34 to define a slot 156 therethrough, and cable 22 is also punched along its median to define a like slot 158; cables 16,22 are then inserted edgewise into cable-receiving opening 98 of terminal assembly 10 towards hinge joints 46 until slots 156,158 align with pins 154 and then cables 16,22 are lowered to rest on the crests of the wave shapes 94 of lower terminal portion 62.

Figure 7:
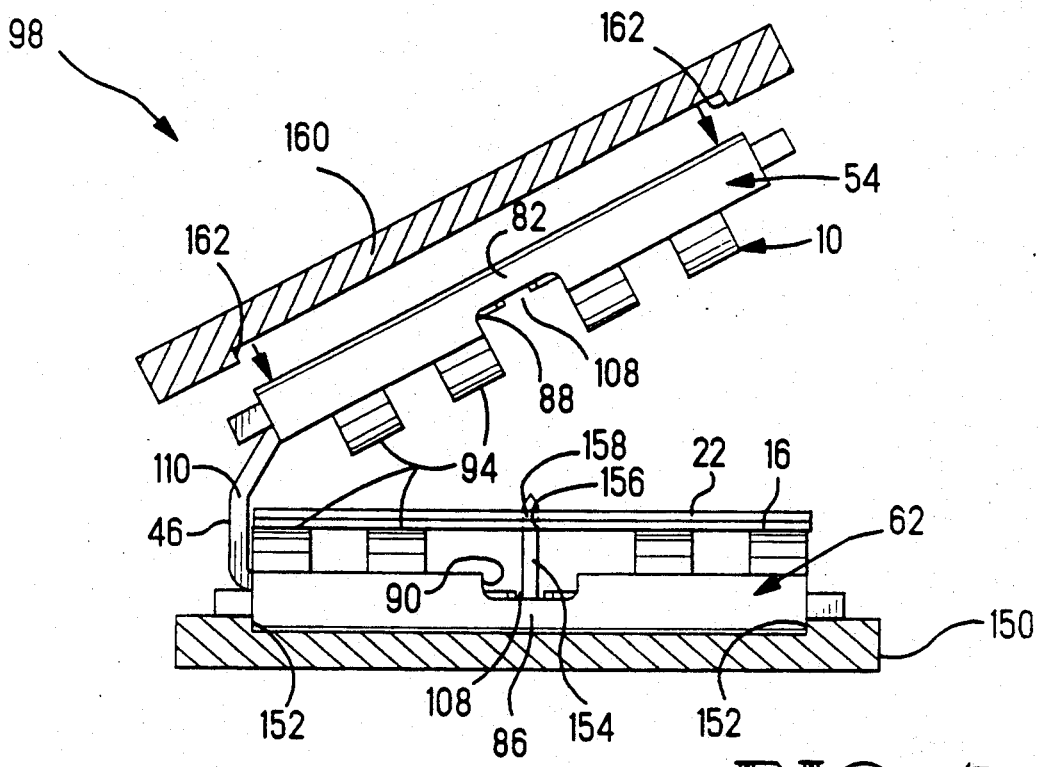
FIGS. 7 to 10 are diagrammatic views of the terminal assembly of FIGS. 5 and 6 within applicator tooling and being applied to a pair of superposed flat power cables for defining an interconnection therebetween.
Figure 8:
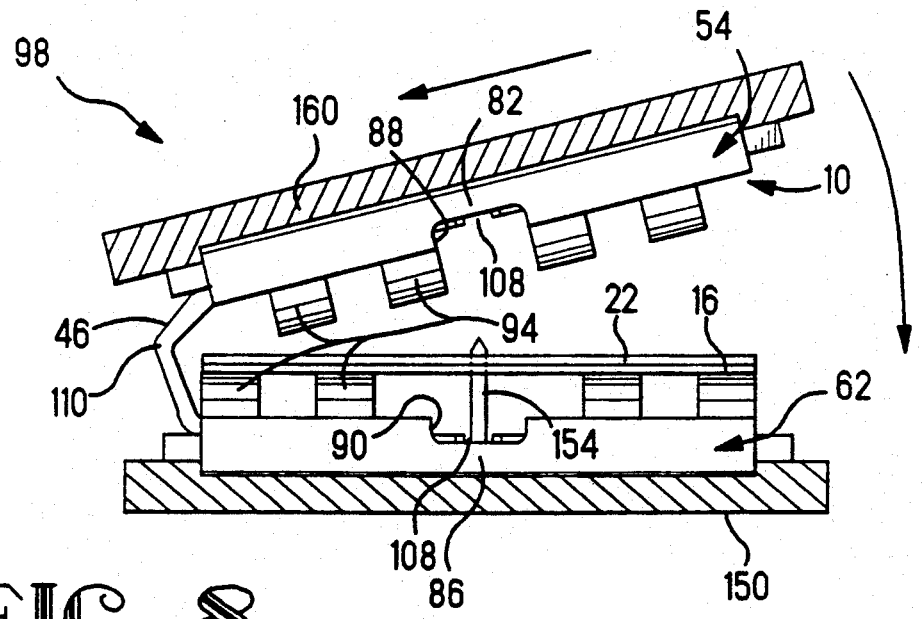
Figure 9:
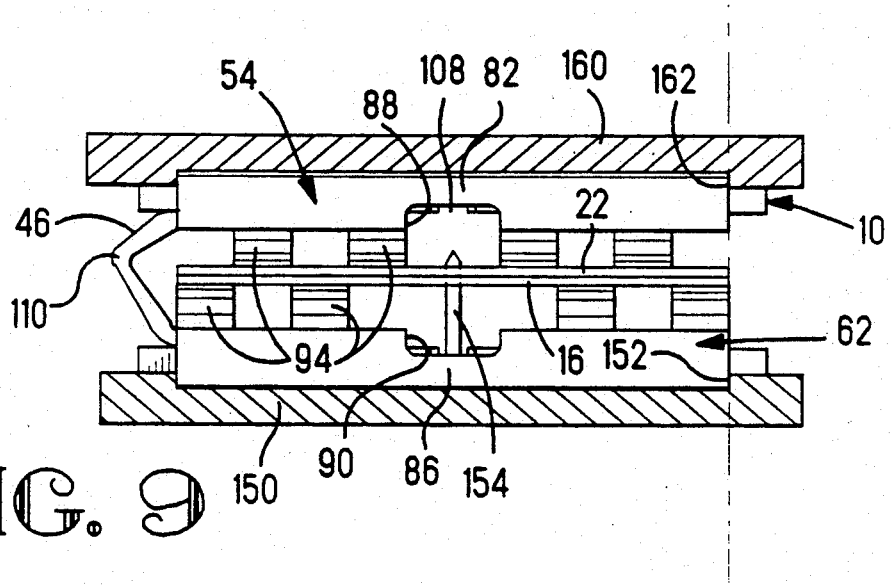
Figure 10:
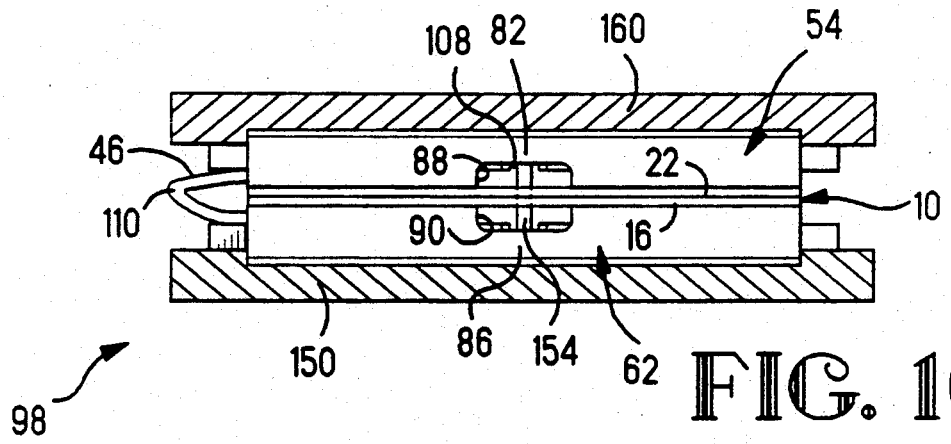
Figure 11:
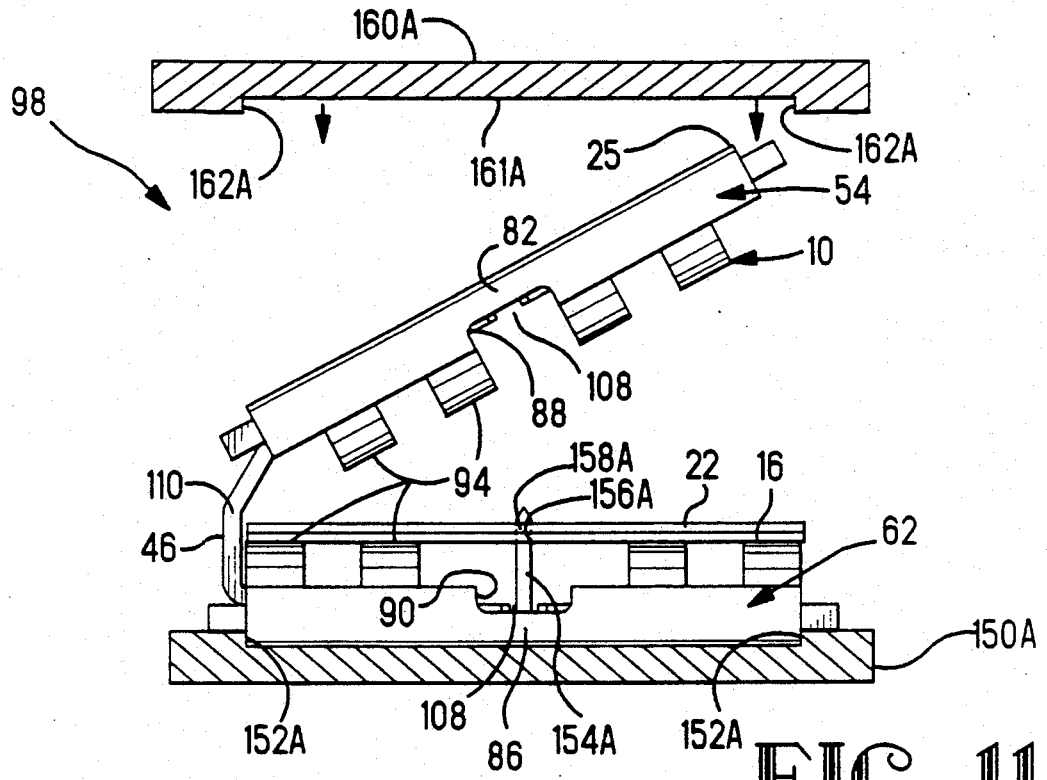
FIGS. 11 and 12 are views similar to FIGS. 7 and 8 utilizing alternate tooling.
Figure 12:
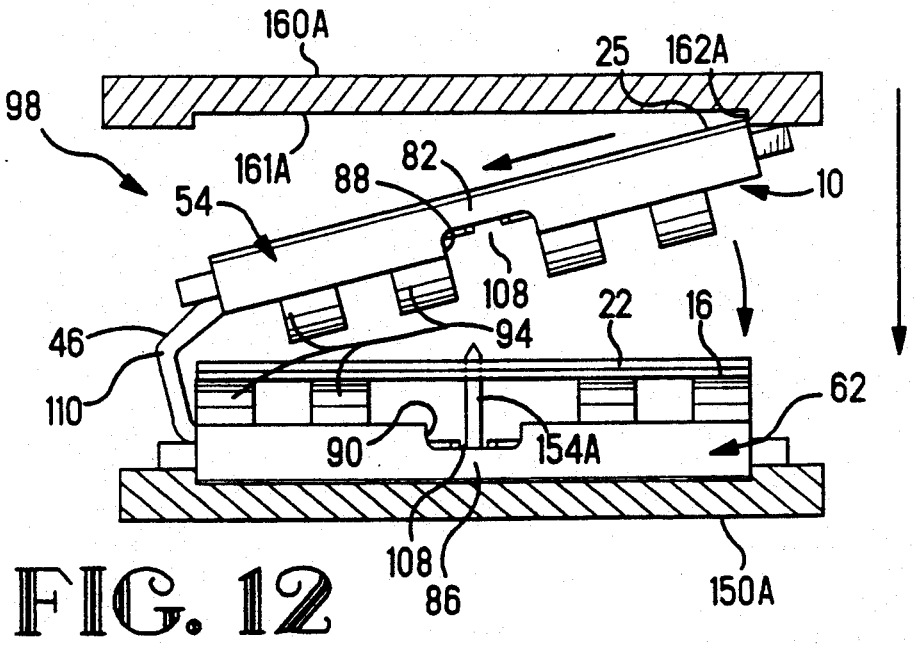

Upper tooling 160 is first brought into engagement with upper terminal portion 54 and locates upper terminal portion 54 between surfaces 162, as seen in FIG. 7. Upper tooling 160 is then carefully rotated to rotate upper terminal portion 54 into parallel alignment with lower terminal portion 62; in precise coordination with lower tooling 150 by means not shown, upper tooling 160 also incrementally translates upper terminal portion 54 to align the array of wave shapes 94 and arcuate relief shapes 96 to complement those of lower terminal portion 62, as seen in FIGS. 8 and 9. Vertical compression is then applied to press upper and lower terminal portions 54,62 against cables 16,22 for wave shapes 94 to shear through the insulation 36 and conductors 12,14;18,20 of the cables 16,22 and express the sheared strips into opposing relief recesses provided by arcuate shapes 96, as seen in FIG. 10. Upper ends of pins 154 extend into opening 88 of cable-proximate member 40 and into gap 108 between insert members 48,50 of upper terminal portion 54. Alternatively, applicator tooling can be utilized which need not be rotated during termination in order to rotate the upper terminal portion disposed at an angle as in FIG. 7. In FIGS. 11 and 12, lower tooling 150A is similar to lower tooling 150 of FIG. 7 to 10; upper tooling 160A is positioned above terminal assembly 10 and is parallel to lower tooling 150A with surfaces 152A,162A aligned. Upper tooling 160A is lowered toward lower tooling 150A and the lower surface 161A thereof eventually engages and bears against leading end 25 of upper terminal portion 54 and initiates rotation of upper terminal portion 54 about bend 110. Upon leading end 25 moving relatively along lower surface 161A until abutting a surface 162A, upper terminal portion 54 is also translated toward bend 110 as it continues to be rotated until it is parallel to lower terminal portion 62 as in FIG. 9. Application is then completed as shown with respect to FIGS. and 10.

Figure 13:
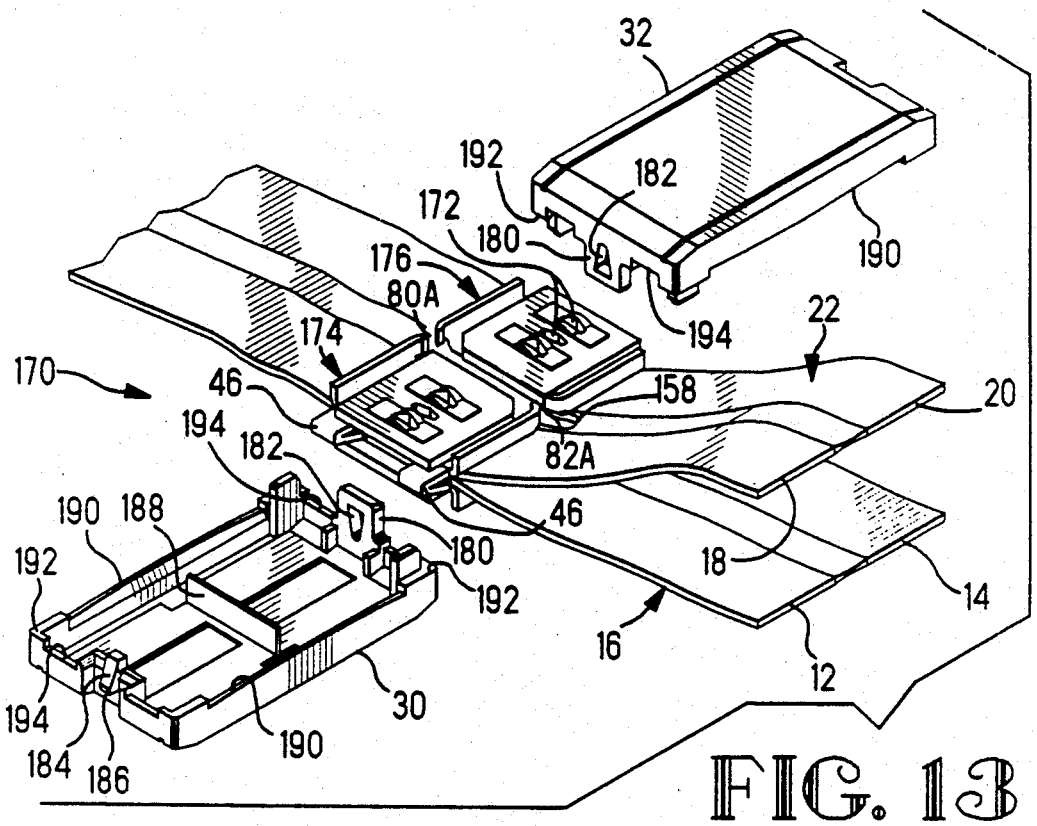
FIG. 13 is an isometric view of the completed termination following severing of the integral terminal assembly of FIG. 1 into discrete terminations associated with respective interconnected conductor pairs of the dual conductor cables, and housing covers to be latched therearound.

Referring to FIG. 13, the termination 170 thus defined interconnecting tap cable 22 with main cable 16 is then staked as indicated by depressions 172 to establish assured gas-tight connections of edges of the wave shapes of the insert members and the cable-proximate member of the terminal assembly with newly sheared edges of the conductor strips expressed into the apertures of the insert members by the wave shapes during application. Ligatures 80,82,84,86 have been severed by tooling (see FIGS. 19 and 20) at 80A,82A of the upper terminal portion (and similarly to the lower terminal portion) to define discrete terminations 174,176 for paired conductors 12,18 and 14,20 and therefore separate electrical circuits between the paired conductors.

Hermaphroditic lower and upper housing covers 30,32 are adapted to be latched to each other over terminations 174,176 with latch arms 180 having latching apertures 182 along one side to ride over latching projections 184 recessed in the corresponding other side of the opposed cover for latching surfaces 186 to latch in apertures 182. Incrementally offset and opposing wall sections 188 pass through the now-sheared ligatures 80A,82A of the upper terminal portion (and similarly of the lower terminal portion) and through gaps 108 between the insert members and through slots 156,158 of cables 16,22 and past portions of each other to define dielectric structure between discrete terminations 174,176. Facing transverse cover edges 190 engage surfaces of cables 16,22; along side edges of cables 16,22 and of the terminations, facing lateral cover edges 192 engage each other along much of the axial length of the cables occupied by the terminations. Incremental gaps 194 can be seen along selected portions of facing lateral cover edges 192 to either side of latch arms 180 and latching projections 184 which will be explained later with reference to FIG. 15.

Figure 14:
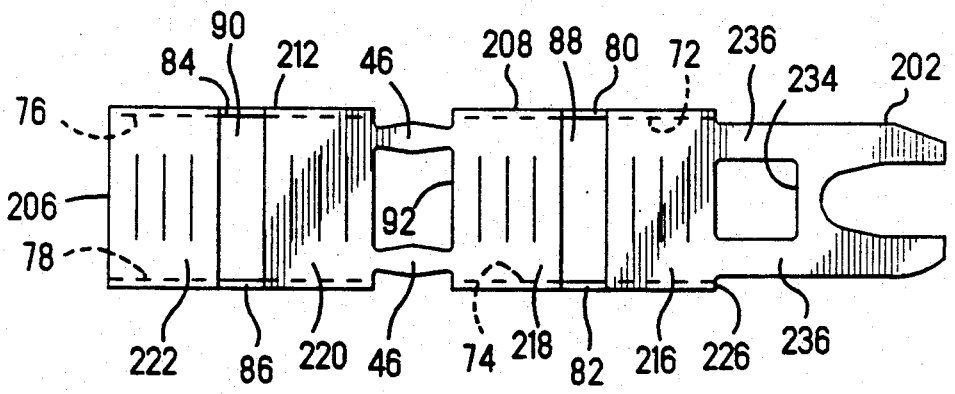
FIGS. 14 to 16 are illustrative of a second embodiment of the present invention, wherein the cable-proximate member includes a contact section extending from an end and outwardly from the cable edge and the housing covers for being connected to a terminal post, shown with one single-conductor cable in FIG. 15 and two such cables in FIG. 16.
Figure 15:
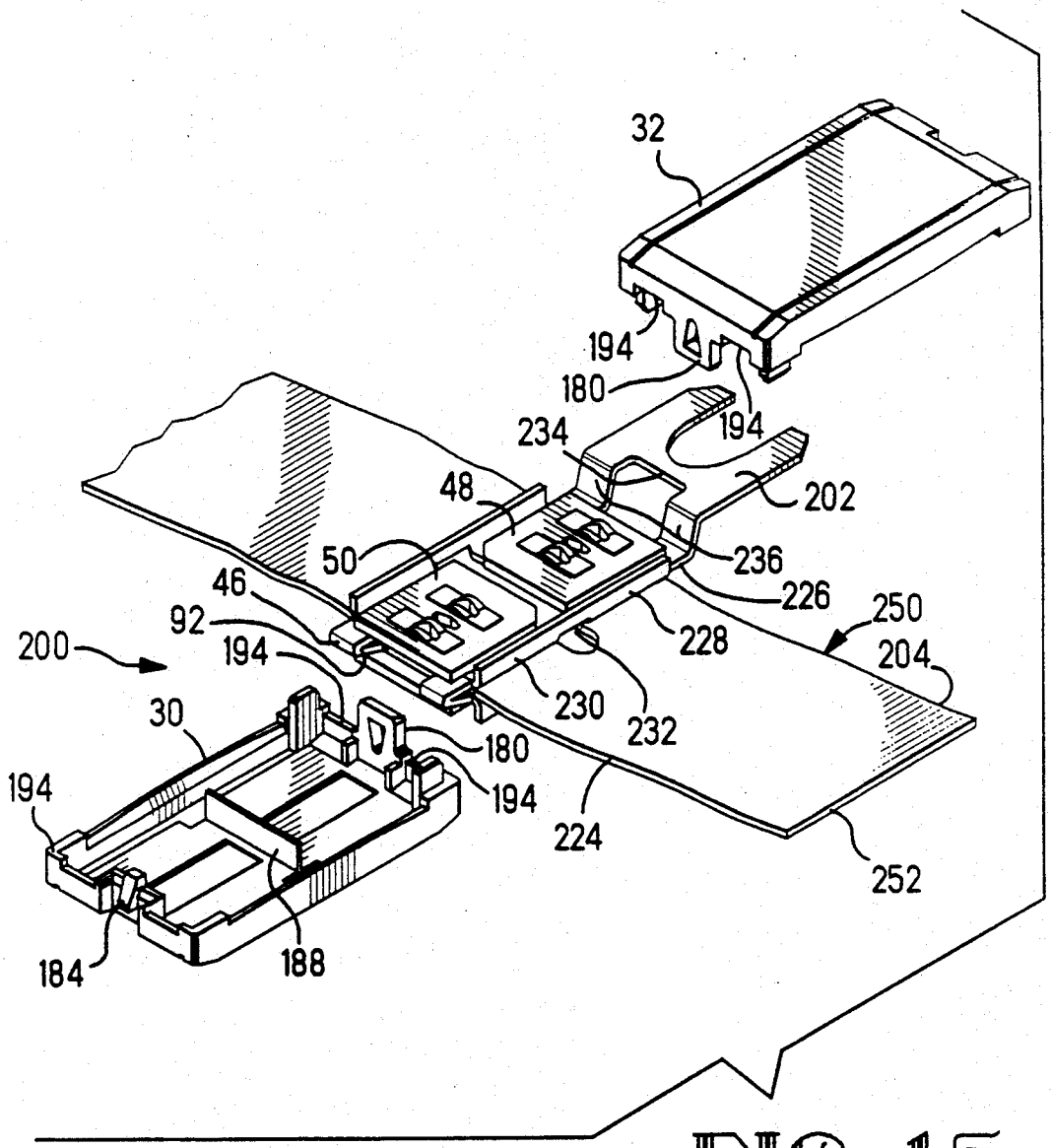
Figure 16:
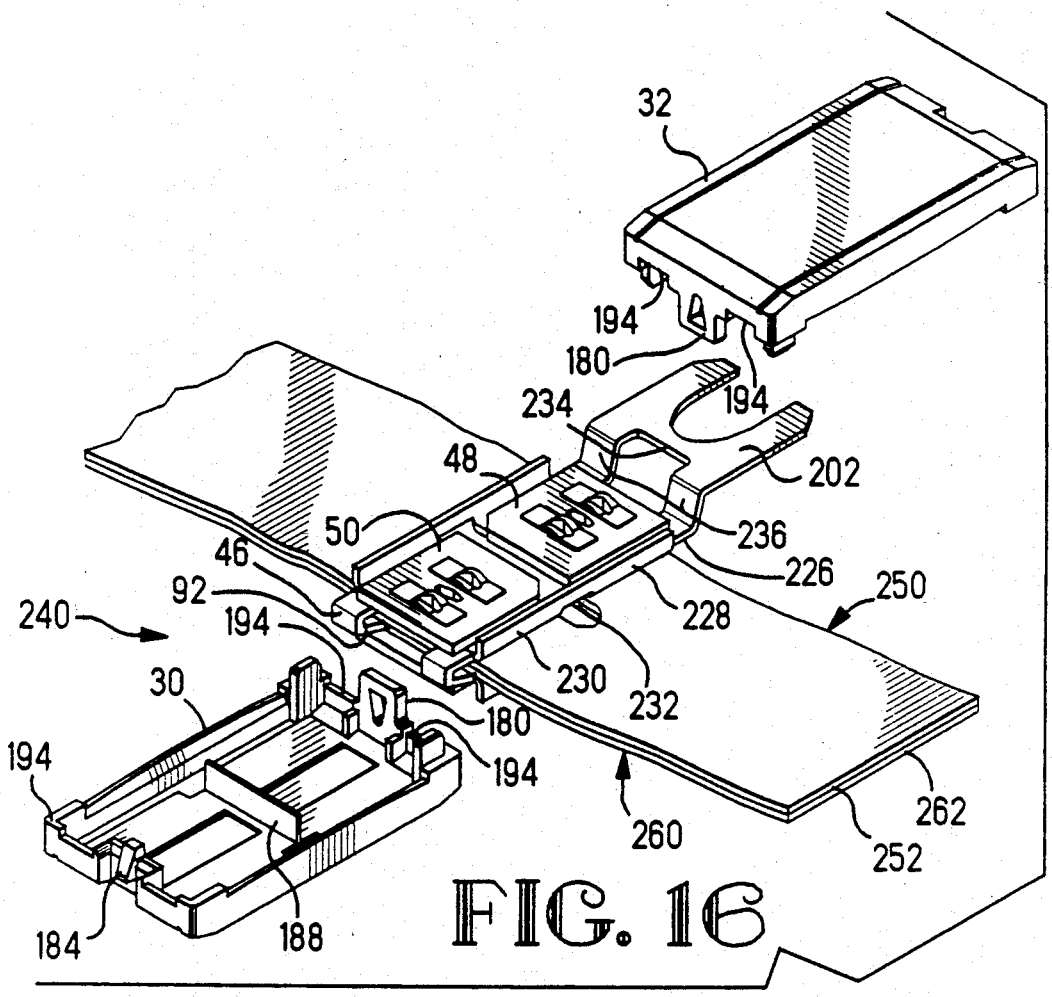

A second embodiment of the present invention is shown in FIGS. 14 to 16. Terminal assembly 200 is terminatable to a middle section of a single-conductor cable 250 (FIG. 15), or a pair of single-conductor cables 250,260 (FIG. 16), and includes a contact section 202 extending integrally therefrom and laterally of first side edge 204 of cable 250 for the single conductor 252 thereof to be electrically connected to another conductor, for tapping. Similarly to the terminal assembly of FIGS. 1 to 13, assembly 200 includes a cable-proximate member 206 to which are affixed four insert members; insert members 48,50 are secured to the cable-remote surface of first terminal portion 208 to define upper terminal portion 210, and another pair of insert members are likewise secured to the cable-remote surface of second terminal portion 212 to define lower terminal portion 214. First and second portions 208,212 include first and second halves 216,218;220,222 joined by pairs of upturned side edges 72,74;76;78 at pairs of opposed ligatures 80,82;84,86. The pairs of opposed ligatures surround openings 88,90, and a pair of hinge sections 46 form an opening 92 which will be disposed along second side edge 224 of cable 250, when terminal assembly 200 is applied to the cable.

Contact section 202 is integrally joined to end edge 226 of first terminal portion 208 of cable-proximate member 204. If the termination is being made to dual-conductor cable such as cable 16 of FIGS. 1 to 13, upon termination and following severing of ligatures 80,82,84,86, contact section 202 will be integral with first termination 228 connected to the conductor adjacent first cable edge 204. Second termination 230 will be isolated from first termination 228 by gap 232 and redundant, the structure having been useful during the termination process.

Housing covers 30,32 can be latched into position over first and second terminations 228,230 with internal wall section 188 of dielectric material protruding through the slot formed in the cable. Contact section 202 of first termination 228 is shaped to permit housing covers 30,32 to be snapped over the terminations by having a large aperture 234 formed between spaced legs 236. Preferably contact section 202 is formed to include an offset at legs 236 to become disposed in a plane beyond the outwardly facing surface of housing cover 32 to provide clearance for fastening contact section 202 to a conventional terminal post for example extending from a surface. The offset is formed such that portions of large aperture 234 define a laterally extending gap sufficient to enable the downwardly extending latch projection of cover 32 and the upwardly extending latch arm 180 of lower cover 30 to coextend past each other within large aperture 234 and latchingly engage. Portions of legs 236 adjacent edge 226 of cable-proximate terminal member 206 extend outwardly through incremental gaps 194 along selected portions of facing lateral cover edges 192 to either side of latch arms 180 and latching projections 184 of covers 30,32.

Referring to FIG. 16, the terminal assembly of FIG. 14 is also applicable to a pair of single-conductor cables 250,260 having conductors 252,262 respectively to define a termination 240. The termination serves to common the conductors of the two cables for the single contact section 202 to transmit the combined currents of both cables to the electrical article to which it is ultimately connected, such as a terminal post (not shown). Even further, a pair of dual-conductor cables could similarly be terminated by the common terminal assembly, if desired, provided that the ligatures are severed thus electrically isolating the two upper terminal portions and two lower terminal portions from each other, respectively.

Figure 17:
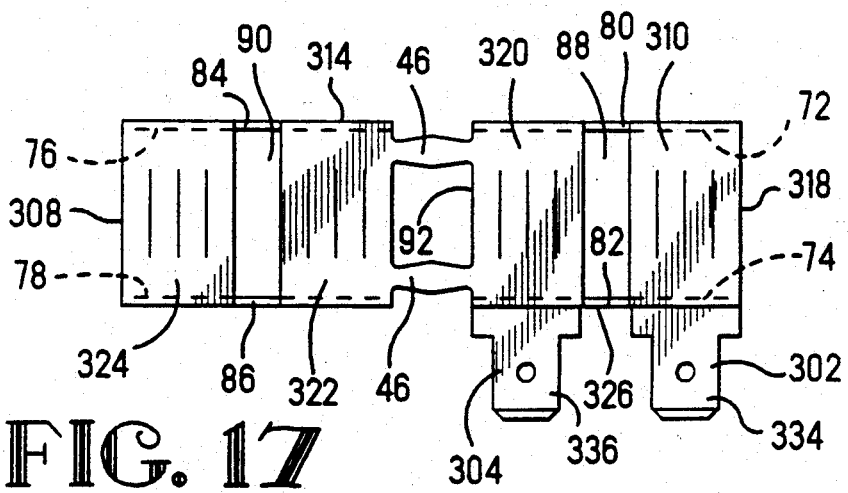
FIGS. 17 and 18 are illustrative of a third embodiment of the present invention, wherein the cable-proximate member includes a pair of contact sections extending from a common side edge and axially along the cable and within cavities of the housing for being connected to complementary contact sections on ends of discrete cables.
Figure 18:
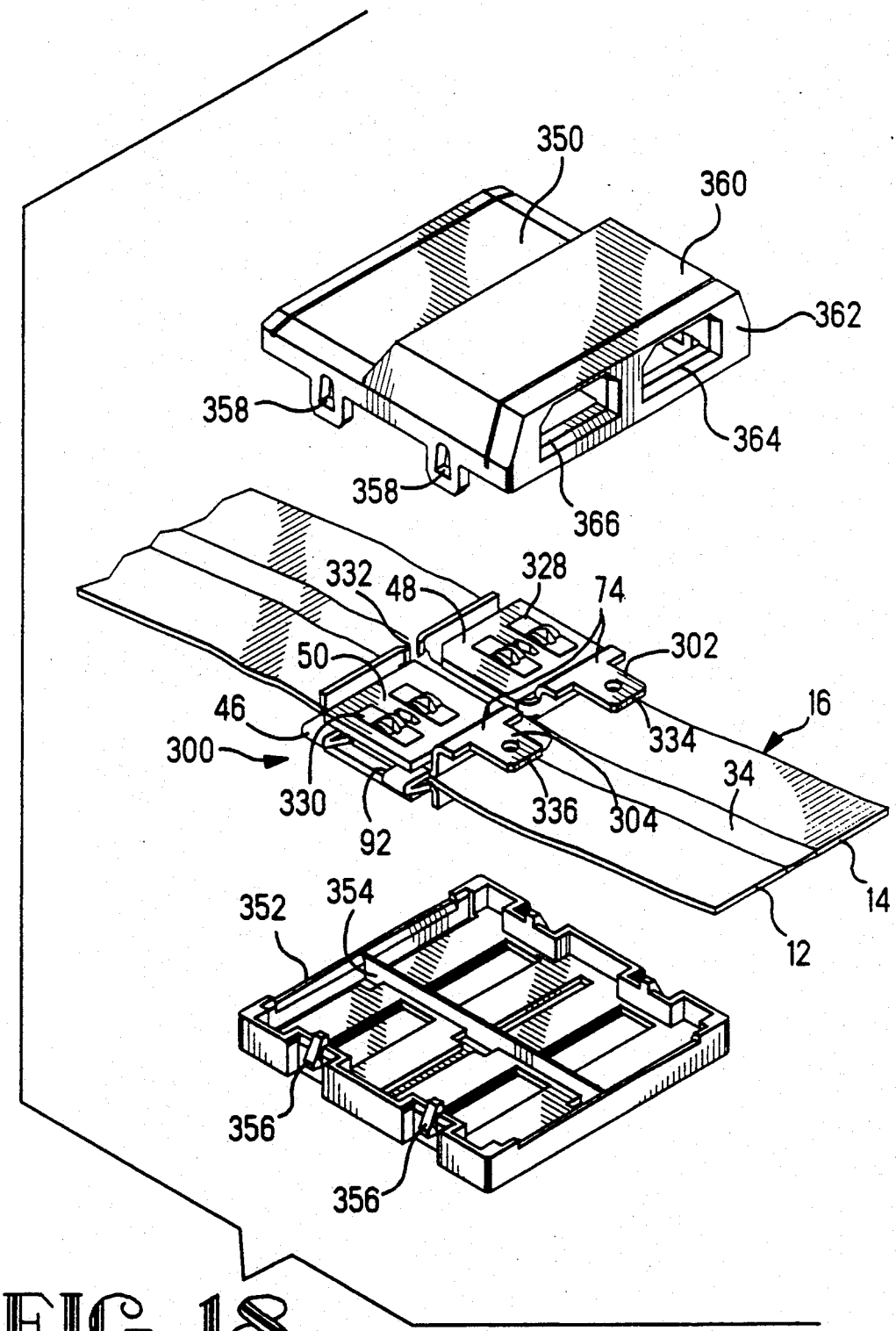

A third embodiment of the present invention is shown in FIGS. 17 and 18. Terminal assembly 300 is terminatable to a middle section of a cable 16 and includes a pair of contact sections 302,304 extending integrally therefrom to be electrically connected to respective other conductors, for tapping. Similarly to the terminal assemblies of FIGS. 1 to 16, assembly 300 includes a cable-proximate member 308 to which are affixed four insert members; insert members 48,50 are secured to the cable-remote surface of first terminal portion 310 to define upper terminal portion 312 and another pair of insert members are likewise secured to the cable-remote surface of second terminal portion 314 to define lower terminal portion 316. First and second portions 310,314 include first and second halves 318,320;322,324 joined by pairs of upturned side edges 72,74;76;78 at pairs of opposed ligatures 80,82;84,86. The pairs of opposed ligatures surround openings 88,90 corresponding to median 34 of cable 16, and a pair of hinge sections 46 form an opening 92 which will be disposed along a side edge of cable 16, when terminal assembly 300 is applied to the cable.

Contact sections 302,304 are integrally joined to end edge 326 of upturned side edge 74 of first terminal portion 310 of cable-proximate member 308. Upon termination and following severing of ligatures 80,82,84,86, contact section 302 will be integral with first termination 328 connected to conductor 14, and second contact section 304 will be integral with second termination 330 will be isolated from first termination 328 by gap 332. Tab sections 334,336 are spaced from the surface of cable 16 by extending from a bend at edge 326 of now-bifurcated upturned side edge 74. Housing covers 350,352 can be latched into position over first and second terminations 328,330 with internal wall section 354 of dielectric material protruding through the slot formed in the cable and between terminations 328,330 where the ligatures have been severed. Housing covers are latchable together with pairs of latching projections 356 along both sides of lower cover 352, and complementary latch arms 358 along both sides of upper cover 350 similarly to the latching arrangement of covers 30,32 of FIGS. 13, 15 and 16.

Housing cover 350 is positioned on that surface of cable 16 along which contact sections 302,304 extend and includes cavities are defined in shroud portion 360 within which contact sections 302,304 are disposed, with apertures 364,366 through forward face 362 providing access in order for tab sections 334,336 of contact sections 302,304 to be mated by tab-receiving receptacle contacts (not shown) which are terminated to separate conductors and housed within silos of dielectric material and are conventional. One example of such contact terminal is a FASTON terminal sold by AMP Incorporated of Harrisburg, Pa. under Part No. 3-350820-2.

Figure 19:
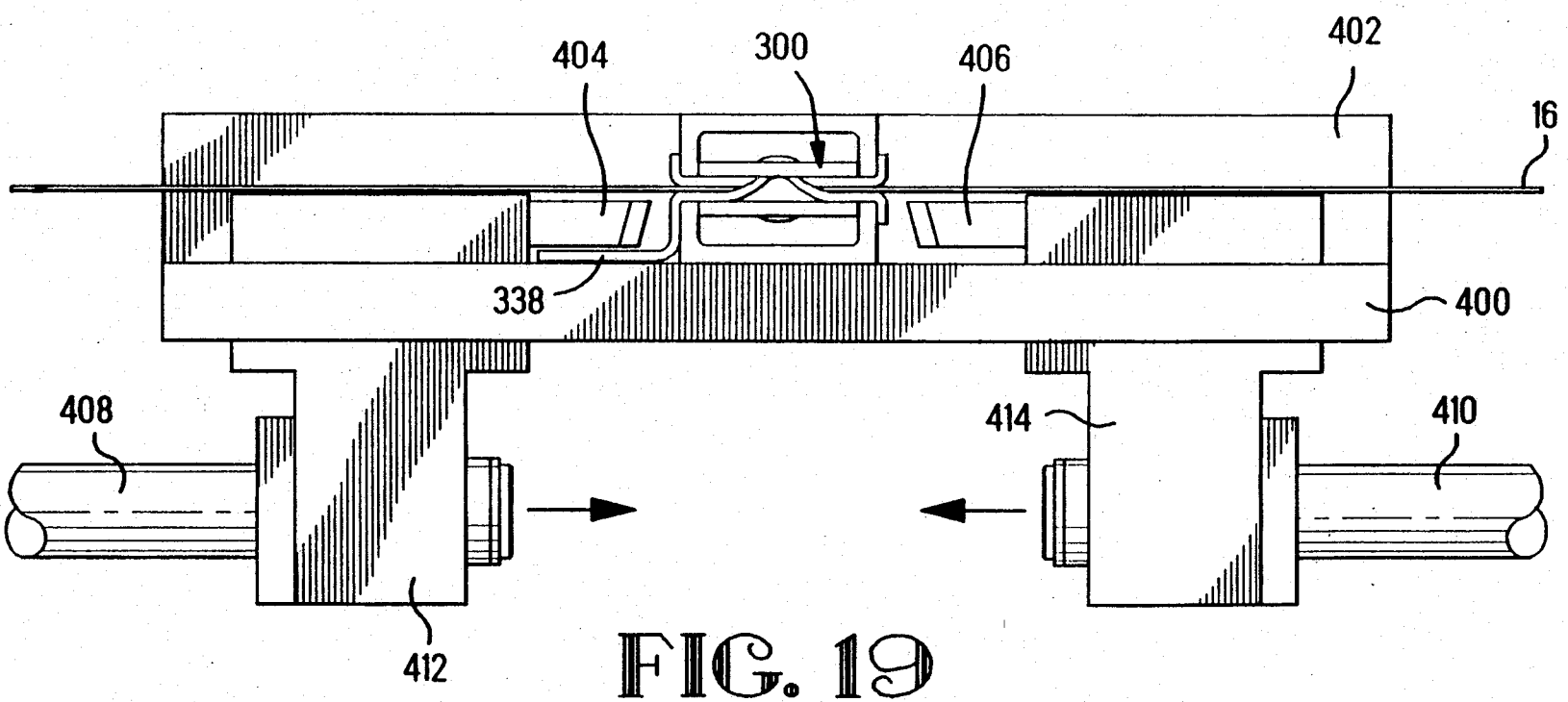
FIGS. 19 and 20 are diagrammatic elevation and plan views of the terminal assembly of FIGS. 17 and 18 within tooling for severing of ligatures between the two halves of the cable-proximate member of the terminal assembly following application to a cable, to define discrete terminations.
Figure 20:
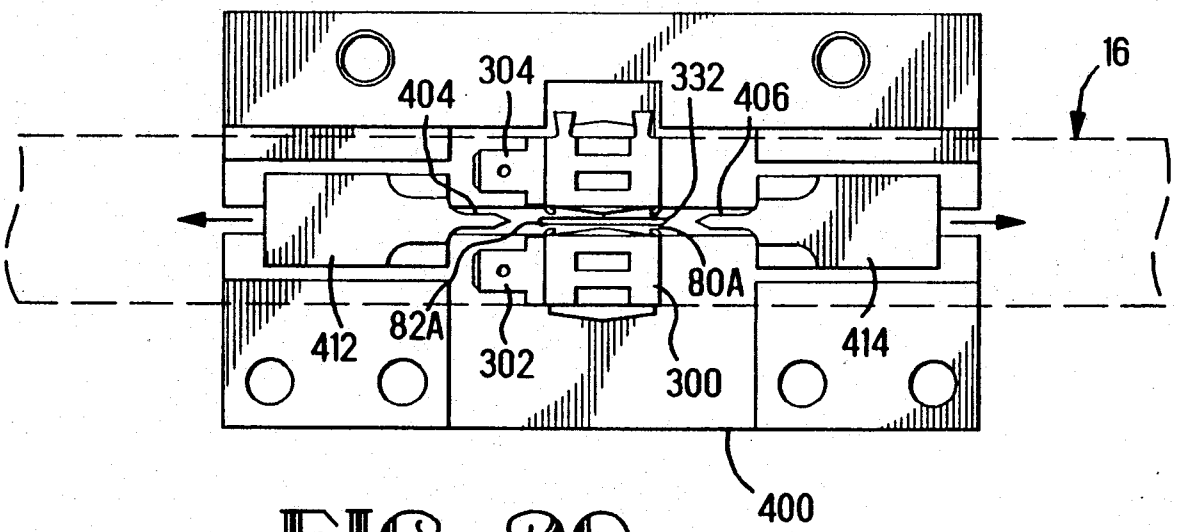

FIGS. 19 and 20 show the method of severing the ligatures of the terminal assemblies of the embodiments of FIGS. 1 to 13 and 17 and 18, and tooling therefor; terminal assembly 300 is representative thereof and is the assembly most complicated of the three to be severed; the embodiment of FIGS. 14 to 16 can also be so severed, if desired. Assembly 300 is nested between lower tooling 400 and upper tooling 402 with ligatures (80,82,84,86 in FIG. 17) positioned to be facing severing blades 404,406. Lower tooling 400 includes reciprocal rams 408,410 which have blade-holding assemblies 412,414 mounted on respective opposing ends thereof. In FIG. 19, blade-holding assemblies 412,414 are in a first position with blades 404,406 spaced from the ligatures of the upper terminal portion which is shown adjacent lower tooling during this step. Upon actuation, blades 404,406 will sever the ligatures with blade 404 moving between the offset portions 338,340 of contact sections 302,304 of the upper terminal portion.

After retraction of blade-holding assemblies 412,414, and opening of upper and lower tooling, terminal assembly 300 is inverted and replaced in the tooling nest. The tooling rams are again actuated and the blades sever the ligatures of the lower terminal portion. FIG. 20 shows the lower tooling with the rams retracting, with the upper terminal portion processed and ligatures thereof severed at 80A,82A to form gap 332 and define first and second terminations 328,330. Cable 16 is shown in phantom enabling blades 404,406 to be clearly shown.

Other variations and modifications of the present invention may be devised which are within the spirit of the invention and the scope of the claims.

What is claimed is:

1. A terminal assembly for terminating an intermediate portion of flat power cable having at least one insulated conductor, comprising:

at least a cable-proximate terminal body member which is integral at least initially and includes opposing upper and lower plate sections extending from a common bendable hinge, said upper and lower plate sections being initially spaced apart to receive a portion of a continuous length of at least one flat cable between facing cable-proximate surfaces thereof transversely with respect to said upper and lower plate sections, and said upper and lower plate sections being at least translatable toward each other;

each of said upper and said lower plate sections having first and second portions separated by a transverse aperture associated with the centerline of said at least one flat cable and extending rom said cable-proximate surfaces to cable-remote surfaces of said upper and lower plate sections, and each of said upper and said lower plate sections having opposing side wall sections extending outwardly substantially perpendicularly from said cable-proximate surfaces and away from said cable-receiving region, with said opposing side wall sections bounding said aperture and at least initially joining said first and second portions; and each of said first and second portions of said upper and lower plate sections including termination regions containing respective arrays of shearing means adapted to penetrate the cable portion inserted therebetween upon said upper and lower plate sections being pressed together to shear the insulation and conductor of said at least one cable therebetween and define sheared conductor strips and extrude said strips outwardly of a plane of said conductor strips for electrical engagement with side edges of adjacent ones of said shearing means for electrical connection therewith, whereby said opposing wall sections are upstanding with respect to said at least one flat cable upon termination thereto, defining easily severable sections adjacent said aperture of each of said upper and lower plate sections to define electrically separate termination structures.

2. A terminal assembly as set forth in claim 1 further including first and second upper insert members secured spaced apart to said cable-remote surface of said upper plate section at respective said first and second upper plate portions, and first and second lower insert members secured spaced apart to said cable-remote surface of said lower plate section at respective said first and second lower plate portions, wherein each said insert member provides upon termination to said at least one flat cable a substantial portion of the electrical engagement surfaces adjacent sheared edges of said conductor strips extruded from said cable plane by said shearing means.

3. A terminal assembly as set forth in claim 1 wherein said upper and lower plate sections are initially disposed at an angle with respect to each other extending from said bendable hinge, whereby said initially integral cable-proximate member is rotatable about an axis of said hinge during termination to said at least one flat cable disposed between said upper and lower plate sections.

4. A terminal assembly as set forth in claim 3 wherein said angle is about 28°.

5. A terminal assembly as set forth in claim 4 further including first and second upper insert members secured to said cable-remote surface of said upper plate section at respective said first and second upper plate portions, and first and second lower insert members secured to said cable-remote surface of said lower plate section at said first and second lower plate portions, wherein each said insert member provides upon termination to said at least one flat cable a substantial portion of the electrical engagement surfaces adjacent sheared edges of said conductor strips extruded from said cable plane by said shearing means.

6. A terminal assembly as set forth in claim 1 wherein a first contact section extends from a free edge of one of said first and second portions of one of said upper and lower plate sections defining a means to electrically engage and be disconnectable form and reconnectable with a corresponding contact means of another electrical article, to electrically connect said another electrical article to a conductor of said at least one flat cable electrically engaged to said one of said first and second portions of said one of said upper and lower plate sections

7. A terminal assembly as set forth in claim 6 wherein said first contact section extends from a free end of said one of said upper and lower plate sections in a direction away from said bendable hinge.

8. A terminal assembly as set forth in claim 7 wherein said first contact section is wide and blade-shaped and includes a large enclosed aperture proximate said termination array of an adjacent one of said first and second portions.

9. A terminal assembly as set forth in claim 6 further including a second contact section extending from a free edge of an other of said first and second portions of said one of said upper and lower plate sections, whereby upon severing of said opposed wall sections of said upper and lower plate sections each of said first and second portions is electrically connectable to a separate electrical article, for electrically connecting thereto a respective conductor of dual-conductor flat cable to which said terminal assembly is terminated.

10. A terminal assembly as set forth in claim 9 wherein said first and second contact sections extend from a free edge of a common one of said opposed side wall sections of said one of said upper and lower plate sections.

11. A termination of an intermediate portion of flat power cable having at least one insulated conductor, comprising:

at least one flat power cable having at least one insulated conductor;

at least a cable-proximate terminal body member which is integral at least initially and includes including opposing upper and lower plate sections extending from a common bendable hinge, said upper and lower plate sections being initially spaced apart to receive a portion of a continuous length of said at least one flat cable between facing cable-proximate surfaces thereof transversely with respect to said upper and lower plate sections;

each of said upper and said lower plate sections having first and second portions separated by a transverse aperture associated with the centerline of said at least one flat cable and extending from said cable-proximate surfaces to cable-remote surfaces of said upper and lower plate sections, and each of said upper and said lower plate sections substantially perpendicularly from said cable-proximate surfaces and away from said cable-receiving proximate surfaces and away from said cable-receiving region, with said opposing side wall sections bounding said apertures and at least initially joining said first and second portions; and each of said first and second portion sof said upper and lower plate sections including termination regions containing respective arrays of shearing means penetrating the cable portion inserted therebetween upon said upper and lower plate sections being pressed together defining sheared conductor strips extruded outwardly of a plane of said at least one flat cable and exposed sheared edges of said conductor strips engaged with side edges of adjacent ones of said shearing means for electrical connection therewith; and means housing the terminal assembly terminated to said at least one flat cable, whereby said opposing wall sections are upstanding with respect to said at least one flat cable upon termination thereto, defining easily severable sections adjacent said aperture of each of said upper and lower plate sections to define electrically separate termination structures.

12. A termination as set forth in claim 11 wherein said at least one flat cable includes a slot punched therethrough along a centerline thereof aligned with said aperture between said first and second portions of said upper plate section and said aperture between said first and second portions of said lower plate sections, and said housing means includes internal wall sections of dielectric material extending through said slot and through said apertures between said first and second portions of said upper and lower plate sections.

13. A termination as set forth in claim 11 wherein two said flat cables are disposed between said upper and lower plate sections of said terminal assembly.

14. A termination as set forth in claim 13 wherein each said flat cable comprises a pair of flat conductors with said flat conductors superposed with respect to associated flat conductors of the other said flat power cable, and said superposed conductors are electrically interconnected by said first portions of said upper and lower plate sections and second portions of said upper and lower plate sections.

15. A termination as set forth in claim 13 wherein each said flat cable comprises a single conductor, and said terminal assembly commons said conductor of each said flat cable to that of the other said flat cable, and a contact section extends from a free edge of one of said upper and lower plate sections, enabling electrical connection of an electrical article to said commoned conductors for transmission of current of both cables to said electrical article.

16. A termination as set forth in claim 11 wherein said terminal assembly is terminated to one said flat cable.

17. A termination as set forth in claim 16 wherein said flat cable comprises a single conductor, and a contact section extends from a free edge of one of said upper and lower plate sections, enabling electrical connection of an electrical article to said conductor for transmission of current of said cable to said electrical article.

18. A termination as set forth in claim 17 wherein said first contact section extends from a free end of said one of said upper and lower plate sections in a direction away from said bendable hinge, said first contact section is wide and blade-shaped and includes a large enclosed aperture proximate a lateral edge of said flat cable, said large enclosed aperture defining a passageway for receipt therethrough of latching means of a pair of opposed cover members of said housing means.

19. A termination as set forth in claim 16 wherein said flat cable comprises a pair of isolated conductors, a first contact section extends from a free edge of one of said first and second portions of one of said upper and lower plate sections, and a second contact section extending from a free edge of an other of said first and second portions of said one of said upper and lower plate sections, whereby upon severing of said opposed wall sections of said upper and lower plate sections each of said first and second portions is electrically connectable to a separate electrical article, for electrically connecting thereto a respective one of said pair of conductors of said flat cable to which said terminal assembly is terminated.

20. A termination as set forth in claim 19 wherein said first and second contact sections coextend from a common initially integral one of said side wall sections and parallel to a surface of said flat cable, and said housing means defines large cavities enshrouding said first and second contact sections and extending inwardly from a terminal-receiving face of said housing means.

* * * * *

UNITED STATES PATENT AND TRADEMARK OFFICE

CERTIFICATE OF CORRECTION

PATENT NO. : 5,219,303

DATED : June 15, 1993

INVENTOR(S) : John K. Daly et al.

It is certified that error appears in the above-identified patent and that said Letters Patent is hereby corrected as shown below:

In claim 1, column 11, line 17, after 'said', second occurrence, insert --at least one flat cable to exposed sheared edges of said--.

In claim 6, column 11, line 65, delete "form" and insert --from--.

In claim 11, column 12, line 56, delete "portion sof" and insert --portions of--.

Signed and Sealed this

Nineteenth Day of April, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,219,303

DATED : June 15, 1993

INVENTOR(S) : John K. Daly et al.

It is certified that error appears in the above-indentified patent and that said Letters Patent is hereby corrected as shown below:

In claim 11, column 12, lines 50-51, delete "proximate surfaces and away from said cable-receiving".

Signed and Sealed this

Fourteenth Day of June, 1994

Bruce Lehman

*Attest:*

BRUCE LEHMAN

*Attesting Officer*

*Commissioner of Patents and Trademarks*